United States Patent [19]

Rapp

[11] Patent Number: 4,817,242

[45] Date of Patent: Apr. 4, 1989

[54] TOILET SEAT SPRING HINGE HAVING AN ADJUSTABLE SPRING FORCE

[76] Inventor: Sandu Z. Rapp, 1865 79th St. Causeway, #15-I The Kennedy House, North Bay Village, Fla. 33141

[21] Appl. No.: 220,676

[22] Filed: Jul. 18, 1988

Related U.S. Application Data

[63] Continuation-in-part of Ser. No. 17,312, Apr. 13, 1987.

[51] Int. Cl.[4] ..... E05F 1/08

[52] U.S. Cl. ..... 16/300; 4/236; 4/240; 16/301

[58] Field of Search ..... 16/234, 235, 236, 237, 16/298, 299, 300, 301; 4/236, 240, 241

[56] References Cited

U.S. PATENT DOCUMENTS

| | | | |
|---|---|---|---|
| 381,100 | 4/1888 | Beath | 16/298 |
| 975,812 | 11/1910 | Watrous | 4/240 |
| 1,529,656 | 3/1965 | Kornhauser | 4/240 |
| 4,428,083 | 1/1984 | Chuang | 4/240 |

*Primary Examiner*—Fred A. Silverberg
*Attorney, Agent, or Firm*—Oltman and Flynn

[57] ABSTRACT

A spring hinge for raising a toilet seat and having an adjustable spring force. First and second hinge members with hinge knuckles that interfit closely end-to-end are attachable respectively to the toilet bowl and the seat. A rod extends through the knuckles and is slidably received in end caps on the hinge members at opposite ends. A first coupling member on the rod presents a series of teeth extending circumferentially around the rod and facing toward the end cap on the second hinge member. A second coupling member on the inside of the second hinge member's end cap has similar teeth which engage the teeth of the first coupling member. A coil spring encircles the rod inside the hinge knuckles and is fastened at one end to the end cap of the first hinge member and at the opposite end to the first coupling member to normally hold the first coupling member in toothed engagement with the second coupling member. The rod may be pushed to disengage the coupling members, after which the rod may be turned to adjust the force of the spring.

8 Claims, 2 Drawing Sheets

TOILET SEAT SPRING HINGE HAVING AN ADJUSTABLE SPRING FORCE

CROSS-REFERENCE TO RELATED APPLICATION

This is a continuation-in-part of my copending U.S. patent application Ser. No. 07/017,312, filed Apr. 13, 1987, now abandoned.

SUMMARY OF THE INVENTION

This invention relates to a toilet seat spring hinge whose spring force can be adjusted to normally hold the toilet seat in a raised position for sanitary reasons and permit the seat to be easily lowered manually.

In the prsently preferred embodimet of this invention, the hinge has a first hinge member fixedly attachable to the top of the toilet bowl at the back and presenting generally tubular hinge knuckles a short distance above. The second hinge member is attachable to a toilet seat and presents generally tubular hinge knuckles that interfit end-to-end with the hinge knuckles of the first hinge member. An elongated rigid rod extends along the inside of the interfitting hinge knuckles and is slidably received in opposite end caps on the two hinge members. A toothed coupling member on the rod is engageable with a complementary toothed coupling member affixed to the end cap of the second hinge member. A coil spring is attached at one end to the end cap of the first hinge member and at the opposite end to the coupling member on the rod. Normally, this spring maintains the coupling member on the rod in toothed engagement with the coupling member on the second hinge member, thereby urging the toilet seat toward its raised position. A person can easily overcome this spring force and lower the toilet seat by pushing down on it. The spring-force is established by pushing the rod longitudinally against the force of the spring to disengage the coupling members, after which the rod may be turned in one direction to tighten the spring of in the opposite direction to relax it.

A principal object of this invention is to provide a novel toilet seat spring hinge having an adjustable spring force.

Another object of this invention is to provide such a spring hinge which is easy to assembly and install.

Further objets and advantages of this invention will be apparent from the following detailed description of a presently preferred embodiment, shown in the accompanying drawing.

Before explaining the disclosed embodiment of the present invention in detail, it is to be understood that the invention is not limited in its application to the details of the particular arrangement shown since the invention is capable of other embodiments. Also, the terminology used herein is for the purpose of description and not of limitation.

DETAILED DESCRIPTION

Figure 4:
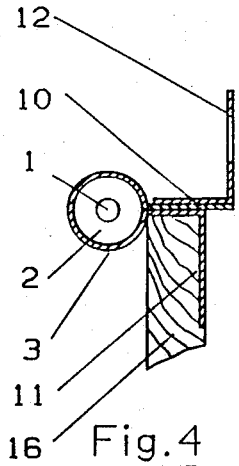
FIG. 4 is a cross-section taken along the line C—C in FIG. 1.
Figure 14:
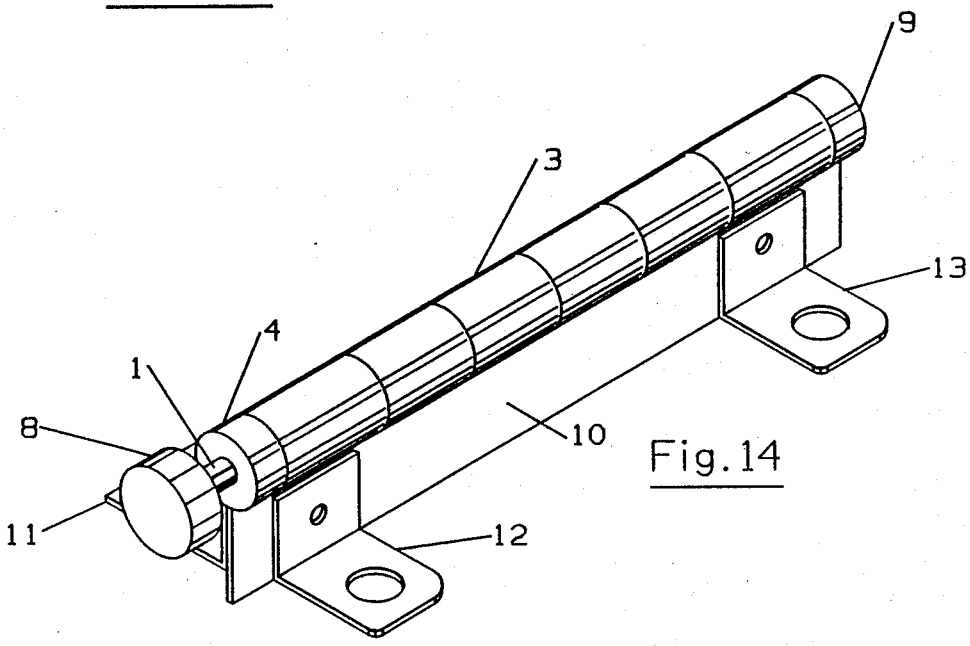
FIG. 14 is an isometric view of the spring hinge.

Referring to FIGS. 4 and 14, the present spring hinge has a first hinge member with an elongated flat plate 10, right-angled brackets 12 and 13 attached to plate 10 and projecting perpendicularly from it along the bottom edge of plate 10 for attachment to the top of a toilet bowl at the back, and three generally tubular, aligned, hinge knuckles 3 joined to the top edge of plate 10 and spaced above the projecting bottom legs of brackets 12 and 13.

Figure 2:
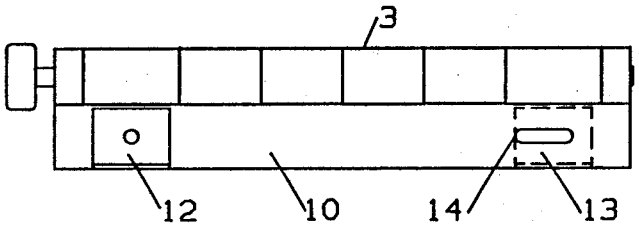
FIG. 2 is a rear elevation of the spring hinge with one mounting bracket removed for clarity.

Brackets 12 and 13 have circular openings in their bottom lets, as shown in FIG. 14, for passing the usual bolts to attach them to the top of the toilet bowl at the back. The toilet bowl has holes for passing these mounting bolts, and the distance between these bolt holes may vary from one brand or style of toilet bowl to another. The upwardly extending legs of brackets 12 and 13 have circular openings for passing screws or blots which attach them to plate 10 of the first hinge member. As shown in FIG. 2, plate 10 has an elongated slot 14 where bracket 13 is attached, so that the position of this bracket along the first hinge member can be adjusted to match the position of the corresponding bolt hole in the toilet bowl at the back.

Figure 6:
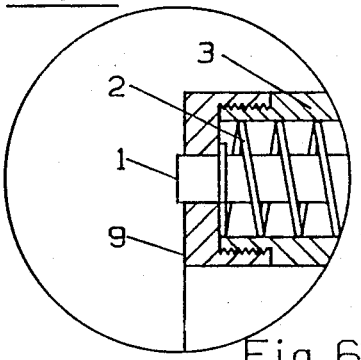
FIG. 6 is an enlarged fragmentary longitudinal section showing the parts at the left end of the hinge in FIG. 1.
Figure 7:
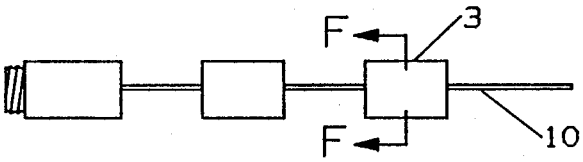
FIG. 7 is a top view of one of the hinge members with its mounting brackets removed.
Figure 8:
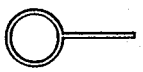
FIG. 8 is a cross-section taken along the line F—F in FIG. 7.

As best seen in FIG. 7, the hinge knuckles 3 on the first hinge member are spaced apart lengthwise of its plate 10. An externally screw-threaded annular stem extends axially outward from the hinge knuckle 3 at the left end of the first hinge member in this Figure. A first end cap 9 is screw-threadedly attached to this stem, as shown in enlarged detail in FIG. 6. This end cap has a circular central opening which is coaxial with the cylindrical openings through the hinge knuckles along the length of the first hinge member.

Figure 5:
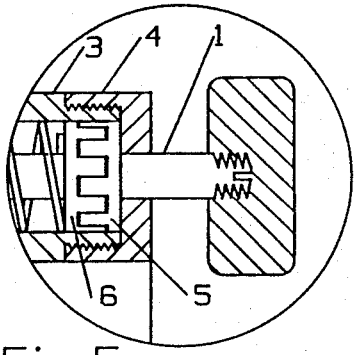
FIG. 5 is an enlarged fragmentary longitudinal section showing the parts at the right end of the hinge in FIG. 1.
Figure 3:
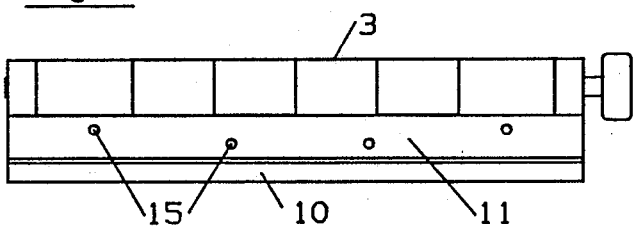
FIG. 3 is a front elevation.
Figure 9:
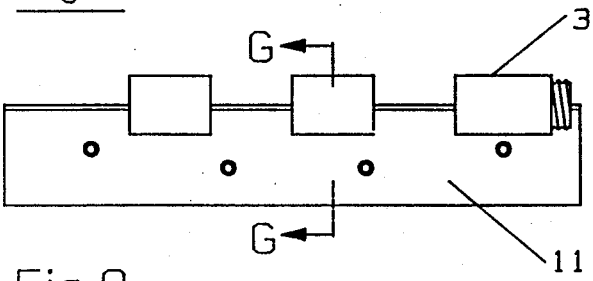
FIG. 9 is a top view of the other hinge member.
Figure 10:
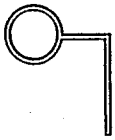
FIG. 10 is a cross-section taken along the line G—G in FIG. 9.
Figure 11:
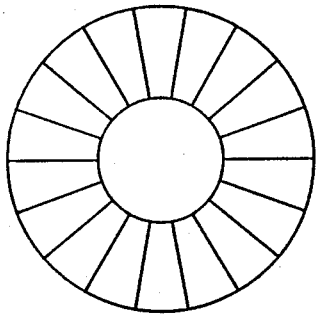
FIG. 11 is a plan view of one of the toothed coupling members in the spring hinge.
Figure 12:
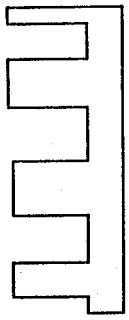
FIG. 12 is a side elevation of this coupling member.

The present spring hinge has a second hinge member with an elongated plate 11 of right-angled cross-section having holes 15 (FIG. 1) for receiving screws to attach it to the bottom of a toilet seat 16 (FIG. 4). At the top the second hinge member has three generally tubular, aligned, hinge knuckles 3 spaced apart along its length and fitting closely end-to-end next to the hinge knuckles of the first hinge member, as shown in FIG. 3. In FIG. 9, at the right end of the second hinge member an externally screw-threaded, annular stem extends axially outward from the hinge knuckle there. A second end cap 4, shown in enlarged detail in FIG. 5, is screw-threadedly attached to this stem. This end cap has a circular central opening coaxial with the cylindrical openings through the hinge knuckles of the second hinge member, which are coaxial with those of the hinge knuckles of the first hinge member.

The openings in the first and second end caps 9 and 4 slidably receive an elongated rigid rod 1 of solid cylindrical configuration, which extends loosely through the interfitting hinge knuckles of the first and second hinge members. On its right end in FIG. 1, axially outward post the second end cap 4, the rod 1 has a screw-threaded extension with a screw-driver slot 7 in its outer end. A knob 8 is screw-threadedly attached to and removable from rod 1 at this end.

A first coupling member 6 is rigidly affixed to rod 1 toward the end of this rod where the knob 8 is located. This first coupling member presents a series of teeth in succession circumferentially around rod 1 and facing toward the second end cap 4. Coupling member 6 is slidably received inside the screw-threaded hollow stem on the second hinge member on which the second end cap 4 is mounted.

Figure 13:
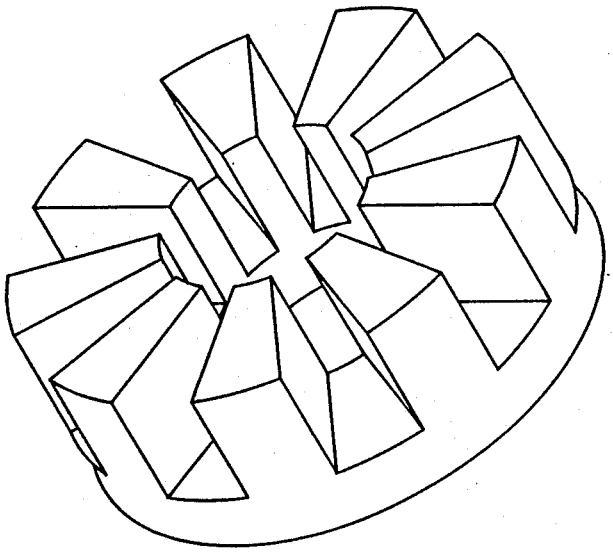
FIG. 13 is an isometric view of this coupling member.

Rigidly affixed to the axially inward face of the second end cap 4 is a second coupling member 5, which presents a series of teeth (FIG. 13) in succession circumferentially around rod 1 and facing toward the first end cap 9 at the opposite end of the hinge. Coupling member 5 is snugly received inside the threaded stem of the hinge knuckle 3 on which the second end cap 4 is threadedly mounted.

The two coupling members 5 and 6 are in confronting relationship to one another. Their teeth can interfit with each other, as shown in FIG. 5, to lock the coupling members together. The first coupling member 6 is slidable along the inside of the hinge knuckles 3.

A coil spring 2 encircles the rod 1 inside the successive hinge knuckles 3 of the two hinge members. One end of spring 2 is secured to the first end cap 9 at its axially inward face. The opposite end of spring 2 is affixed to the first coupling member 6. The spring 2 is under torsion between the first end cap 9 and the first coupling member 6, and it urges the first coupling member 6 into toothed engagement with the second coupling member 5.

Figure 1:
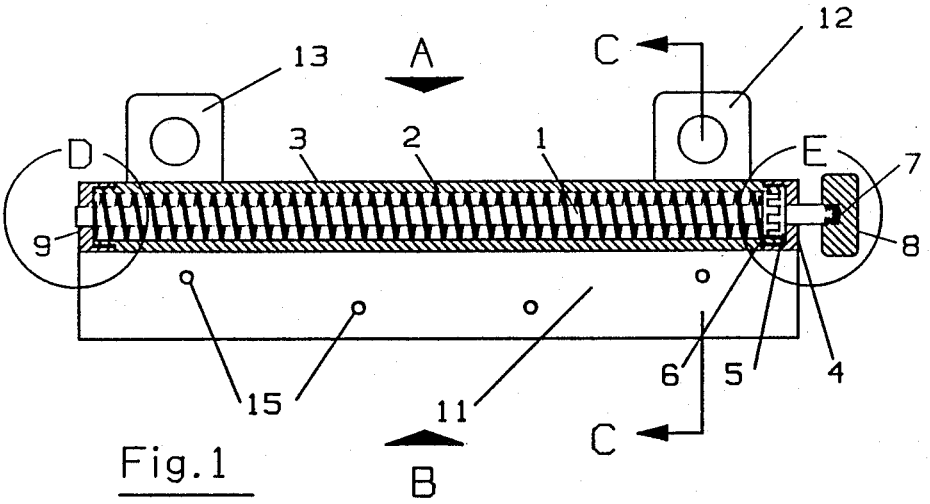
FIG. 1 is a longitudinal sectional view of the present toilet seat spring hinge.

By grasping the knob 8 and pushing the rod 1 to the left in FIG. 1 against the force of spring 2, the first coupling member 6 (which is affixed to the rod) can be disengaged from the second coupling member 5. With the toothed coupling members disengaged, the force of spring 2 can be adjusted by turning rod 1 in one direction to tighten the spring and increase its force or in the opposite direction to relax the spring and decrease its force. Following this, the knob 8 is released and spring 2 returns rod 1 to the position in which the toothed coupling members 5 and 6 engage one another. Once the desired spring force has been set, the knob 8 may be removed to make it more difficult for an unauthorized person to tamper with the spring adjustment. An authorized person can use a screw driver inserted into the end slot 7 in the rod to push in and turn the rod if it becomes necessary to adjust the spring again.

After the spring adjustment has been set, the compressive force of the spring holds the first coupling member 6 in toothed engagement with the second coupling member 5, thereby coupling the second hinge member 11 and 3 to rod 1. The torsional force of the spring acts between the first end cap 9 on the first hinge member (which is attached to the toilet bowl) and rod 1, causing rod 1 to rotate on its own axis in a direction for raising the toilet seat (which is attached to the second hinge member). Therefore, spring 2 normally holds the toilet seat in its raised position. A person can lower the seat manually by pushing down on the free end of the seat (away from the hinge).

A particular advantage of the present invention is the ease with which the hinge can be assembled. The second end cap 4 is threadedly attached to the second hinge member, with the second toothed coupling member 6 received in the threaded stem on the end of the adjoining hinge knuckle 3 of the second hinge member. Either before or after this attachment is made, the two hinge members are positioned with their hinge knuckles interfitting closely end-to-end and with the first end cap 9 detached from the first hinge member. The unitary assembly of rod 1, first coupling member 6 on the rod, coil spring 2 encircling the rod and attached at one end to coupling member 6, and the first end cap 9 attached to the opposite end of spring 2 is inserted from the left end in FIG. 1 along the inside of the end-to-end hinge knuckles 3 of the first and second hinge members. Coupling member 6 comes into toothed engagement with coupling member 5 on the inside of the second end cap 4. The first end cap 9 is screwed onto the threaded stem at the left end of the first hinge member in FIG. 1. This positions the rod 1 axially of the hinge knuckles with its left end projecting slightly beyond the first end cap 9 and its right end projecting beyond the second end cap 4 far enough to permit the knob 8 to be threadedly attached.

If desired, the plate 10 and the mounting brackets 12 and 13 of the first hinge member can be combined in a one-piece, integral body. Also, if desired the end caps 4 and 9 can be designed for snap-on attachment instead of screw-threaded attachment to the respective hinge members.

I claim:

1. A spring hinge or attaching a toilet seat to a toilet bowl comprising:

a first hinge member having mounting means for attachment to the top of the toilet bowl and a plurality of substantially tubular, aligned, hinge knuckles above said mounting means;

a second hinge member having attachment means for attachment to the toilet seat and a plurality of substantially tubular, aligned, hinge knuckles fitting end-to-end between and in axial alignment with said hinge knuckles of the first hinge member;

a rigid rod extending along the inside of said hinge knuckles of said first and second hinge members and slidably supported by said first and second hinge members;

a first coupling member affixed to said rod and presenting a series of teeth in succession circumferentially around said rod and facing toward one end of said rod;

a second coupling member affixed to said second hinge member and presenting a series of teeth in succession circumferentially around said rod and facing toward said teeth of the first coupling member;

and a coil spring encircling said rod inside said hinge knuckles and acting between said first coupling member and said first hinge member to normally hold said first coupling member in toothed engagement with said second coupling member;

said rod being slidably displaceable manually along said hinge members to disengage said first coupling member from said second coupling member, after which said rod can be rotated to adjust the force of said spring said first hinge member has a manually attachable and removable first end cap at one end of the hinge knuckles of said first and second hinge members;

said second hinge member has a manually attachable and removable second end cap at the opposite end of the hinge knuckles of said first and second hinge members;

said rod is slidably supported by and slidably movable relative to said end caps;

said spring is attached at one end to said first end cap and at its opposite end to said first coupling member;

and said second coupling member is attached to the inside of said second end cap and its teeth face toward said first end cap.

2. A spring hinge according to claim 1 and further comprising:

a knob on said rod axially outward from said second end cap.

3. A spring hinge according to claim 2 wherein:

said knob is detachably mounted on said rod at one end;

and said end of the rod has a screw-driver slot therein enabling the rod to be pushed in and turned by a screw-driver to adjust the force of said spring on said first coupling member.

4. A spring hinge according to claim 3 wherein said rod projects axially beyond said first and second end caps.

5. A spring hinge according to claim 4 wherein said first end cap is screw-threadedly mounted on said first hinge member, and said second end cap is a screw-threadedly mounted on said second hinge member.

6. A spring hinge according to claim 1 wherein said rod projects axially beyond said first and second end caps.

7. A spring hinge according to claim 6 wherein said first end cap is screw-threadedly mounted on said first hinge member, and said second end cap is screw-threadedly mounted on said second hinge member.

8. A spring hinge according to claim 1 wherein said first end cap is screw-threadedly mounted on said first hinge member, and said second end cap is screw-threadedly mounted on said second hinge member.

* * * * *